US005498147A

United States Patent [19]

Katagiri et al.

[11] Patent Number: 5,498,147

[45] Date of Patent: Mar. 12, 1996

[54] POWDER MOLDING PRESS

[75] Inventors: Takeshi Katagiri, Machida; Masao Yamamoto; Tukasa Tajima, both of Kawasaki; Siro Shirasaki, Yokohama, all of Japan

[73] Assignee: Yoshizuka Seiki Co., Ltd., Kawasaki, Japan

[21] Appl. No.: 267,651

[22] Filed: Jun. 29, 1994

Related U.S. Application Data

[62] Division of Ser. No. 744,182, Aug. 9, 1991, Pat. No. 5,326,242.

[30] Foreign Application Priority Data

Aug. 10, 1990 [JP] Japan ..... 2-213508
Aug. 7, 1991 [JP] Japan ..... 3-222198

[51] Int. Cl.[6] ..... B22F 3/02

[52] U.S. Cl. ..... 425/78; 264/109; 264/332; 264/334; 419/68; 425/352; 425/355; 425/411

[58] Field of Search ..... 425/78, 352, 353, 425/77, 355, 354, 410, 411; 264/109, 319, 332, 334; 419/42, 49, 68

[56] References Cited

U.S. PATENT DOCUMENTS

| | | | |
|---|---|---|---|
| 2,499,980 | 3/1950 | Stokes, Jr. et al. | 425/352 |
| 3,353,215 | 11/1967 | Haller | 425/78 |
| 4,482,307 | 11/1984 | Schaidl et al. | 425/78 |
| 5,326,242 | 7/1994 | Katagiri et al. | 425/78 |

FOREIGN PATENT DOCUMENTS

| | | | |
|---|---|---|---|
| 46-42556 | 12/1971 | Japan | 425/78 |

*Primary Examiner*—Jay H. Woo
*Assistant Examiner*—Joseph Leyson
*Attorney, Agent, or Firm*—Armstrong, Westerman, Hattori, McLeland & Naughton

[57] ABSTRACT

A powder molding press a die plate provided with a die having a die hole, a punch device to be inserted into the die hole and a hydraulic cylinder device attached to the punch device for driving the same, the hydraulic cylinder device being arranged coaxially with the punch device. A movable punch plate may be disposed on one side of the die plate in parallel thereto with a predetermined space and a punch adapter for securing the punch device to the punch plate may be also disposed. The punch device includes a plurality of punches disposed axially in series. In this connection, a plurality of punch plates, hydraulic cylinder assemblies and punch adapters are arranged in a manner that succeeding cylindrical punches disposed axially in series are secured to corresponding punch plates through corresponding punch adapters each being inserted into a directly preceding punch adapter to be axially movable and that succeeding hydraulic cylinder assemblies for actuating corresponding punch plates are disposed axially in series each between a corresponding punch plate and a directly succeeding punch plate and arranged coaxially with corresponding punch adapters so that the succeeding punch adapter is axially movable along an inner peripheral surface of the through hole of a directly preceding hydraulic cylinder assembly.

3 Claims, 15 Drawing Sheets

POWDER MOLDING PRESS

This is a division of application Ser. No. 07/744,182 filed Aug. 9, 1991, now U.S. Pat. 5,326,242.

BACKGROUND OF THE INVENTION

The present invention relates to a powder molding press particularly utilized for a powder metallurgy technology.

In a conventional art, there has been provided various powder molding presses, one example of which is shown in FIG. 19 of a kind disclosed in the Japanese Patent Laid-open Publication No. 53-80867. Referring to FIG. 19, a powder molding press comprises a die plate 100 to which is mounted a die 101 provided with a die hole 110. Powder 111 filling the die hole 110 is pressed by the cooperation of upper and lower punch devices 104 and 105. The lower punch device 105 comprises first, second and third punches 105A, B and 105C disposed axially concentrically and relatively movably, thereby being capable of molding a stepped product.

First, second and third punch plates 107A, 107B and 108 are disposed with axially predetermined spaces with each other so as to correspond to the first, second and third punches 105A, 105B and 105C, respectively. The first and second punch plates 107A and 107B are movable and the third punch plate 108 is stationary.

The first punch 105A, which is the outermost one of the lower punch device 105, is secured be the first punch plate 107A disposed near the die plate 100 through a hollow cylindrical punch adapter 102A. The second punch 105B, which is disposed inside the first punch 105A, is secured to the second punch plate 107B disposed below the first punch plate 107A through a second punch adapter 102B which is inserted into the first punch adapter 102A so as to be axially movable along the inner peripheral surface thereof. The third punch 105C, which is disposed further inside the second punch 105B, is secured to the third punch plate 108 through a third punch adapter 102C disposed inside second punch adapter 102B.

In a molding operation, the upper punch device 104 is lowered by an upper ram, not shown, to be inserted into the die hole 110, and the die plate 100 is then lowered with a predetermined timing by a lower ram, not shown through a drawing yoke 106, whereby the powder filling in the die hole 110 is pressed into a molded product having a predetermined shape by the cooperation of the upper and lower punch devices 104 and 105.

The lowering movement of the first punch plate 107A is limited by a first mechanical stopper 109A disposed between the movable first and stationary third punch plates 107A and 108, and the lowering movement of the second punch plate 107B is limited by a second mechanical stopper 109B disposed between the movable second and stationary third punch plates 1078 and 108, whereby the first and second punches 105A and 105B of the lower punch device 105 are positioned in the die hole 110.

The first and second mechanical stoppers 109A and 109B are both secured to the stationary third punch plate 108 in an arrangement offset in angles of 90° in the circumferential direction. Respectively two first and second mechanical stoppers 109A and 109B are arranged at symmetrical portions in cross shape, and in FIG. 18, the first and second mechanical stoppers 109A and 109B are shown in half sections with bilateral angular displacement of 90° for showing them on one drawing sheet.

The conventional powder molding press of the structure described above, however, provides the following problems.

According to the structure of the conventional powder molding press, when the lowering movements of the first and second punch plates 107A and 10713 are limited by the first and second mechanical stoppers 109A and 109B, load acting points X1 and X2 of the first and second punch adapters 109A and 109B with respect to the first and second punch plates 107A and 107B and load supporting points Y1 and Y2 of the first and second mechanical stoppers 109A and 109B are offset in a direction normal to the axial direction of the mechanical stoppers by amounts of d1 and d2, respectively, as shown in FIG. 19. Because of the presence of these offsets d1 and d2, bending moments M1 and M2, shown by arrows, for downwardly bending the inner end of the first and second punch plates 107A and 107B are caused, which may result in the deformation of the first and second punch plates 107A and 107B, which may further adversely result in the displacement in position of the first and second punches 105A and 105B of the lower punch device 105 from the predetermined positions in the die hole 110, thus degrading the working performance of the molded product.

In order to obviate this defect, it may be possible to increase the bending rigidity of the first and second punch plates 107A and 107B by increasing the thicknesses thereof, which, however, results in the increasing of the total height of the molding press and also of the manufacturing cost.

In addition, since the first and second mechanical stoppers 109A and 109B are secured to the stationary punch plate 108 in cross shape, these mechanical stoppers are disposed at only two positions in a viewpoint of space, and accordingly, it is impossible to arrange more than two movable punch plates such as 107A and 107B.

Furthermore, it is necessary for the first and second punch plates 107A and 107B to be guided by guide rods, for example, not shown, for maintaining the relative positional relationship with respect to the upper and lower punch devices 104 and 105, but in a case where the bending moments M1 and M2 are caused, it becomes hard to maintain the relative positional precision between the die 101 and the upper and lower punch devices 104 and 105.

SUMMARY OF THE INVENTION

An object of the present invention is to substantially eliminate defects or drawbacks encountered in the prior art and to provide a powder molding press capable achieving the coaxial alignment of the punch device and the hydraulic cylinder assembly for driving the same.

Another object of the present invention is to provide a powder molding press capable of preventing the punch plate from being applied with a bending moment during a powder pressing step, having structure including a plurality of arrangements of the punch plates and improving the performance of the positional relationship between the upper and lower punch devices.

These and other objects can be achieved according to the present invention by providing, in one aspect, a powder molding press comprising:

a die plate provided with a die having a die hole;

a punch device to be inserted into the die hole; and a hydraulic cylinder device attached to the punch device for actuating punch device, the hydraulic cylinder device being arranged coaxially with the punch device.

The punch device includes a plurality of punches arranged coaxially and the hydraulic cylinder devices includes a plurality of hydraulic cylinder assemblies respectively corresponding to the punches and coaxially arranged in series.

In another aspect, there is provided a powder molding press comprising:

a die plate provided with a die having a die hole;

a punch device to be inserted into the die hole;

a movable punch plate disposed on one side of the die plate in parallel thereto with a predetermined space;

a punch adapter for securing the punch device to the punch plate; and a hydraulic cylinder device disposed on one side of the punch plate opposite to the die plate for actuating the punch plate, the hydraulic cylinder device being arranged coaxially with the punch adapter.

The punch device and the punch adapter may be integrally formed with each other.

In a further aspect, there is provided a powder molding press comprising:

a die plate provided with a die having a die hole to be filled up with powder;

a pair of cooperating punch devices for pressing the powder at least one of the punch devices comprising a plurality of cylindrical punches which are assembled concentrically with each other to be relatively movable;

a plurality of punch plates including first, second, third and succeeding punch plates and being disposed in parallel to the die plate and in respectively correspondingly to the cylindrical punches with spaces with each other in an axial direction thereof;

a plurality of hollow cylindrical punch adapters including one punch adapter corresponding to each cylinder punch and being disposed in relation to the punch plates in a manner wherein an outermost cylindrical punch of the concentrically arranged plural punches is secured to the first punch plate disposed near the die plate through a first punch adapter, a second cylindrical punch of the plural punches disposed inside the outermost cylindrical punch is secured to the second punch plate disposed axially below the first punch plate through a second punch adapter which extends within the first punch adapter and is axially movable along an inner peripheral surface of the first punch adapter, and each succeeding cylindrical punch disposed concentrically relative to said second cylindrical punch is secured to a corresponding punch plate through corresponding punch adapters with each punch adapter extending within a preceding punch adapter and is axially movable along an inner peripheral surface of the preceding punch adapter; and a hydraulic cylinder device comprising a plurality of hydraulic cylinder assemblies including one hydraulic cylinder assembly corresponding to each of said cylindrical punches, each hydraulic assembly; being provided with a through hole and axially arranged relative to each other in a manner wherein a first hydraulic cylinder assembly for actuating a first punch plate disposed near the die plate is disposed between the first and second punch plates and is coaxial with the first punch adapter, the second punch adapter extending within a through hole of the first hydraulic cylinder assembly and is axially movable along an inner peripheral surface of the through hole, the second hydraulic cylinder assembly for actuating the second punch plate is disposed between the second punch plate and the third punch plate disposed axially below the second punch plate and coaxially with the second punch adapter, the third punch adapter disposed axially below the second punch adapter extending within a through hole of the second hydraulic cylinder assembly and is axially movable along an inner periperal surface of the through hole of the second hydraulic cylinder assembly, and each succeeding hydraulic cylinder assembly for actuating a corresponding punch plate is disposed axially below the second hydraulic cylinder assembly with each succeeding hydraulic cylinder assembly between a corresponding punch plate and a directly succeeding punch plate and arranged coaxially with corresponding punch adapters so that each succeeding punch adapter is axially movable along an inner peripheral surface of the through hole of a directly preceding hydraulic cylinder assembly.

In a preferred embodiment, each of the hydraulic cylinder assemblies comprises an outer cylinder tube having one end wall in which a rod shaft hole is formed, a movable member accommodated in the cylinder tube to be axially slidable and hydraulically operated in a reciprocal motion therein, and a rod integrally secured to the movable member and slidably extending from the rod shall hole, the punch plate corresponding to the each of the hydraulic cylinder assemblies being secured to an end portion of the rod and the through hole of each of the hydraulic cylinder assemblies penetrating another end wall of the cylinder tube, the rod and the movable member. The hydraulic cylinder assembly further comprises a hollow guide shaft integrally formed with the movable member so as to extend on a side opposing the rod, the guide shaft being inserted to be slidable in a guide shaft hole formed to another end wall of the cylinder tube.

According to the characters of the powder molding press of the present invention, the punch plate is positioned and hold to the predetermined position by the operation of the hydraulic cylinder assembly during the powder molding process. The hydraulic cylinder assembly is arranged coaxially with the punch adapter, so that the load acting point on the punch plate due to the punch adapter and the supporting point due to the hydraulic cylinder assembly are aligned with each other on substantially the same axial line, thus effectively eliminating the cause of a bending moment to the punch plate as experienced in the prior are.

In an example in which a plurality of punch plates are disposed, since the succeeding punch adapters are inserted in order into the through holes of the preceding hydraulic cylinder assemblies, the multiple stage structure of the press can be realized without causing a space problem.

Furthermore, in an example in which a hollow rod integrally formed to the movable member of the hydraulic cylinder assembly is disposed so as to exend on the side opposite to the rod of the movable member so that the rod is inserted into a guide shaft hole formed on one end wall of the cylinder tube of the hydraulic cylinder assembly and to be slidable therein, the concentricity between the rod and the cylinder tube can be enhanced, thus the performance of the hydraulic cylinder assembly is improved.

The powder intruded into a space between the surfaces of the punch adapters and the inner sliding surfaces of the through holes of the respective hydraulic cylinder assemblies through the gaps between the respective punches is removed outside the cylinder tubes through gaps between the guide shaft and the outer peripheries of the punch adapters, thus preventing the powder from being intruded into the operation oil existing in the cylinder tubes.

DESCRIPTION OF THE PREFERRED EMBODIMENTS

The first embodiment according to the present invention will be first described hereunder with reference FIGS. 1 to 8.

Figure 1:
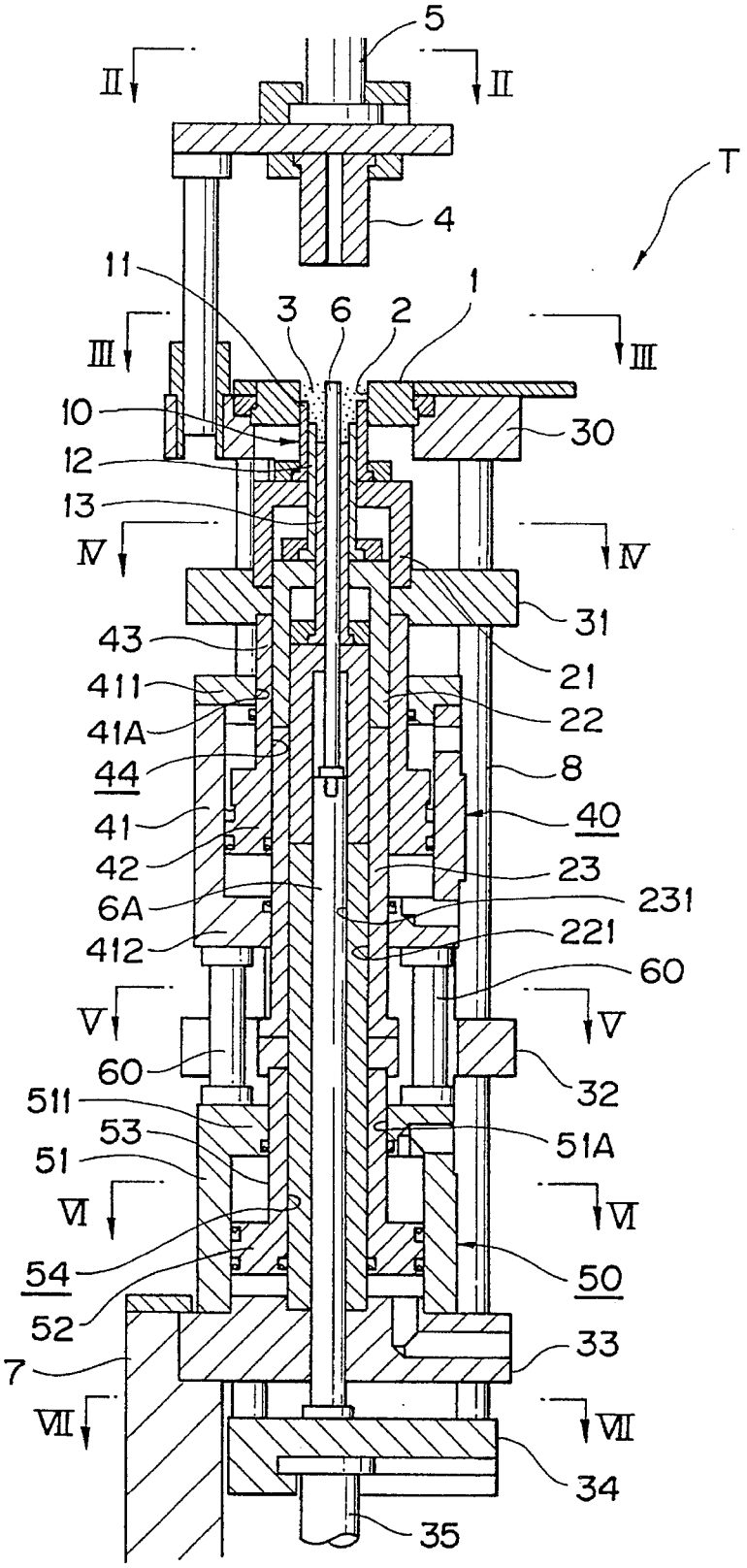
FIG. 1 is an elevational section of a powder molding press according to one embodiment of the present invention.
Figure 2:
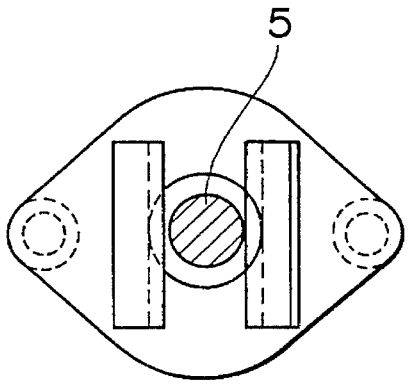
FIGS. 2 to 7 are sectional views taken along the lines II—II, III—III, IV—IV, V—V, VI—VI and VII—VII in FIG. 1 respectively.
Figure 3:
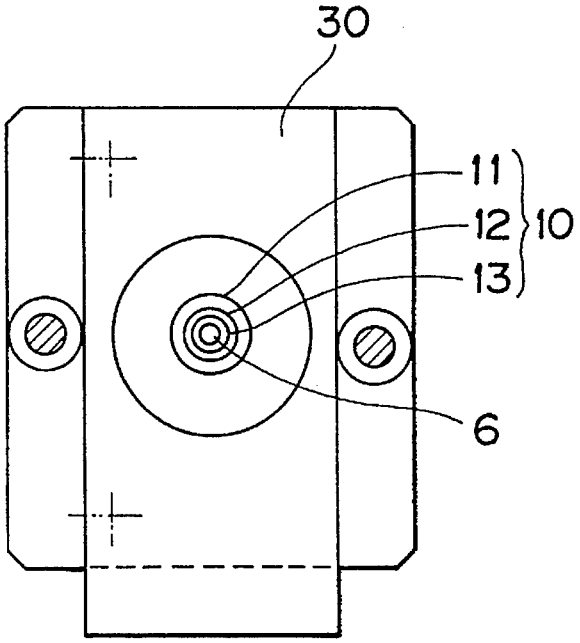
Figure 4:
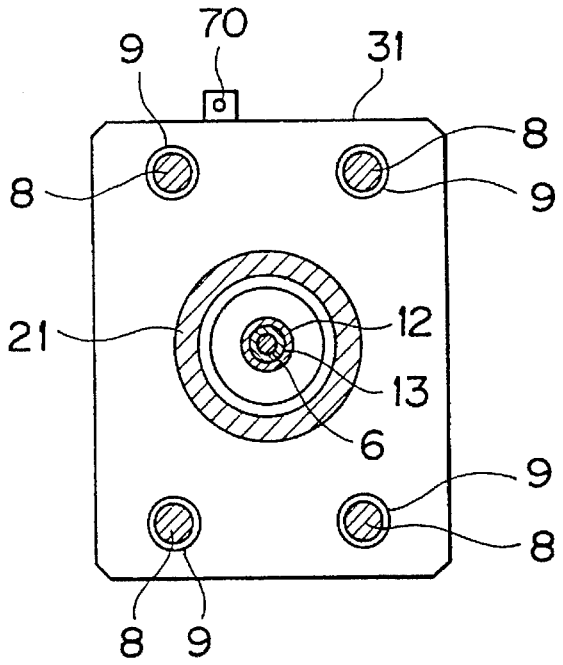
Figure 5:
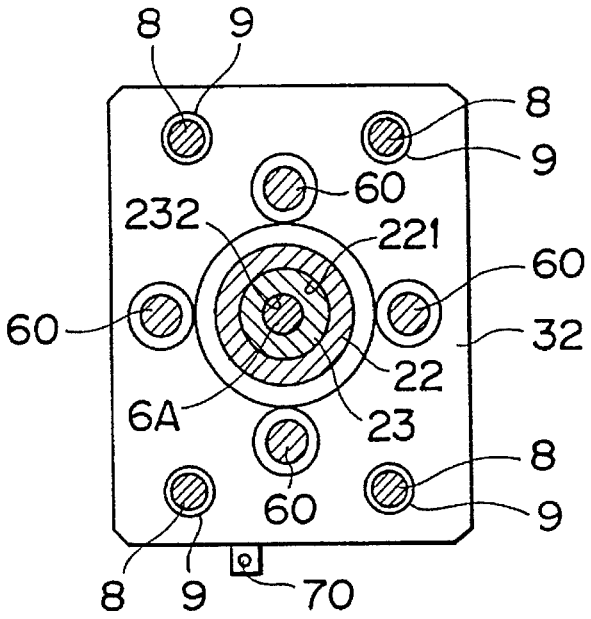
Figure 6:
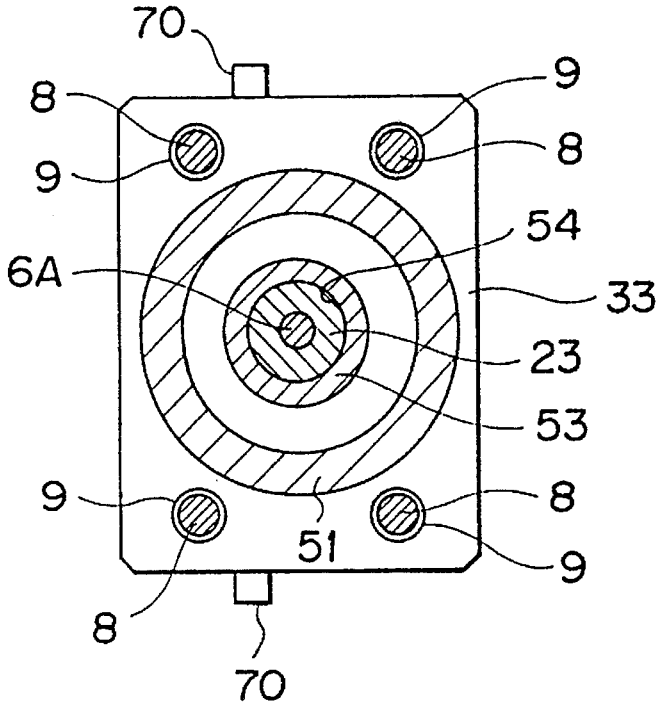
Figure 7:
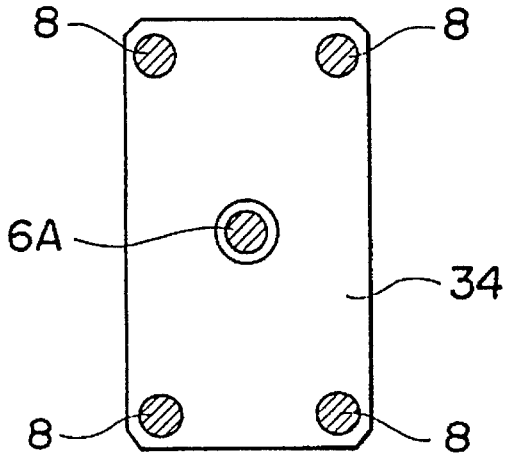

Referring to FIG. 1, a character T denotes a tool set of a powder molding press of the first embodiment according to the present invention, and the tool set T is comprised of a die 1 provided with a die hole 2 and upper and lower punch devices 4 and 10 for pressing material powder 3 filling the die hole 2.

The upper punch device 4 is secured to an upper ram 5 so as to be inserted into -the die hole 2 by lowering the ram 5 to press the material powder 3 in the die hole 2. The lower punch device 10 comprises first, second and third cylindrical punches 11, 12 and 13 which are axially concentrically fitted to each other with a core rod 6 being the center thereof. The first punch 11 disposed outermost in these lower punches is secured through a first punch adaper 21 to a movable first punch plate 31 disposed near a die plate 30 supporting the die 1.

The second punch 12 disposed inside the first punch 11 is secured through a second punch adapter 22 to a second punch plate 32 disposed below the first punch plate 31, and the third punch 13 disposed further inside the second punch 12 is secured through a third punch adapter 23 to a stationary plate 33 secured to a body of the molding press, as a third punch plate in this embodiment, disposed further below the second punch plate 32.

In the functional meaning, the punch plates 31 and 32 may be said as rotation preventing plates or members for preventing rotation of the first and second punches 11 and 12 and the first and second punch adapters 21 and 22, but these are referred to as punch plates herein for the sake of convenience.

To the lower end of the molding press is disposed a drawing yoke 34, which is operatively connected to the die plate 30 through a coupling rod 8. The coupling rod 8 extends vertically and penetrates through a bushing 9, the first and second punch plates 31 and 32 and the stationary plate 33 so that the respective plates 31, 32 and 33 can be relatively reciprocally moved in a parallel condition with each other.

The first and second punches 11 and 12 are actuated by means of hydraulic cylinder assemblies 40 and 50 respectively arranged in series, which are also connected to the first and second punch plates 31 and 32 coaxial with the first and second punches 11 and 12, respectively.

The first hydraulic cylinder assembly 40 is disposed between the first and second punch plates 31 and 32, and the second hydraulic cylinder 50 assembly is disposed between the second punch plate 32 and the stationary plate 33, both the first and second hydraulic cylinder assemblies 40 and 50 being connected to each other through columnar members 60.

The hydraulic cylinder assemblies 40 and 50 have circular hollow cross sections having through holes 44 and 54, providing a so-called doughnut or annular structure, extending along the central axis. The second punch 12 is secured to the second punch plate 32 through the second punch adapter 22 inserted into the through hole 44 of the first hydraulic cylinder assembly 40 to be reciprocal in a liquid-tight condition in this embodiment.

The first hydraulic cylinder assembly 40 comprises an outer cylinder tube 41 and a piston 42 as a movable member which is accommodated in the cylinder tube 41 to be movable in a reciprocal motion there in by a hydraulic pressure. To the piston 42 is integrally secured a piston rod 43 connected to the first punch plate 31. The piston rod 43 is inserted slidably into a rod shaft hole 41A formed at one end wall 411 of the cylinder tube 41. The through hole 44 is formed so as to penetrate the other end wall 412 of the cylinder tube 41, the piston rod 43 and the piston 42.

While, the second hydraulic cylinder assembly 50 comprises an outer cylinder tube 51 and a piston 52 as a movable member to which a piston rod 53 is integrally formed. The piston rod 53 has one end connected to the second punch plate 32. The piston rod 53 is inserted slidably into a rod shaft hole 51A formed at one end wall 511 of the cylinder tube 51. The through hole 54 is formed so as to penetrate the piston rod 53 and the piston 52, and the other end wall of the cylinder -Lube 51 is commonly formed as the stationary plate 33.

The third punch 13 is secured to the stationary plate 33 through the third punch adapter 23, which is inserted to be movable in a reciprocal motion in the through hole 54 with a liquid-tight condition and which is also inserted slidably into a through hole 221 of the second punch adapter 22. The third punch adapter 23 is also provided with an inner through hole 231 into which the core rod 6 and a core rod holder 6A are inserted.

FIGS. 2 to 7 are sectional views of the molding press of FIG. 1 for clearly showing the structure as described above.

The operation of the powder molding press of this structure will described hereunder with reference to FIGS. 11A to 11F.

The molding operation is conducted by pressing the powder in the die hole from the upper and lower sides by the upper and lower punch devices 4 and 10.

Figure 11A:
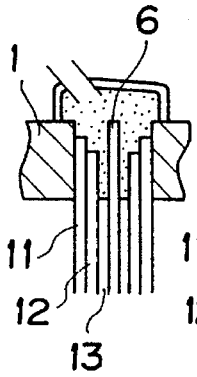
FIGS. 11A to 11F are illustrations showing a molding sequence of the powder molding press of FIG. 1 at the die location.
Figure 11B:
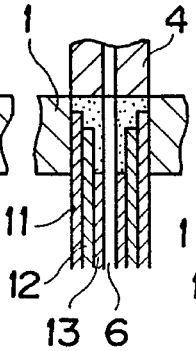
Figure 11C:
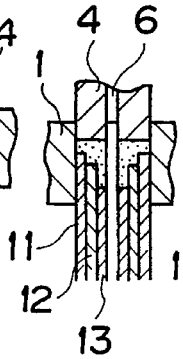
Figure 11D:
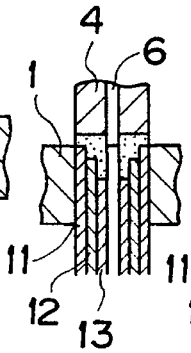
Figure 11E:
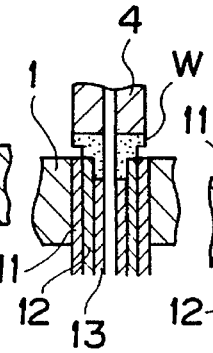
Figure 11F:
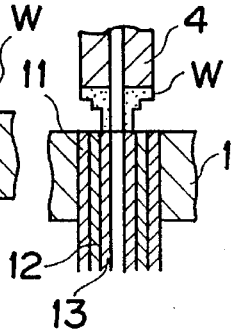

First a FIG. 11A shows a filling step at which the upper punch device 4 is positioned above the die 1. Then, the upper punch device 4 is lowered and the lower punches 11 and 12 of the lower punch device 10 are also lowered to press the powder in the die hole in the steps shown in FIGS. 11B and 11C. In the steps shown in FIGS. 11D to 11F, the die 1 is lowered so that the upper end surfaces of the lower punches 11 and 12 are positioned in a plane in which the upper surface of the die 1 exists, thus taking out a mold product W.

Figure 8:
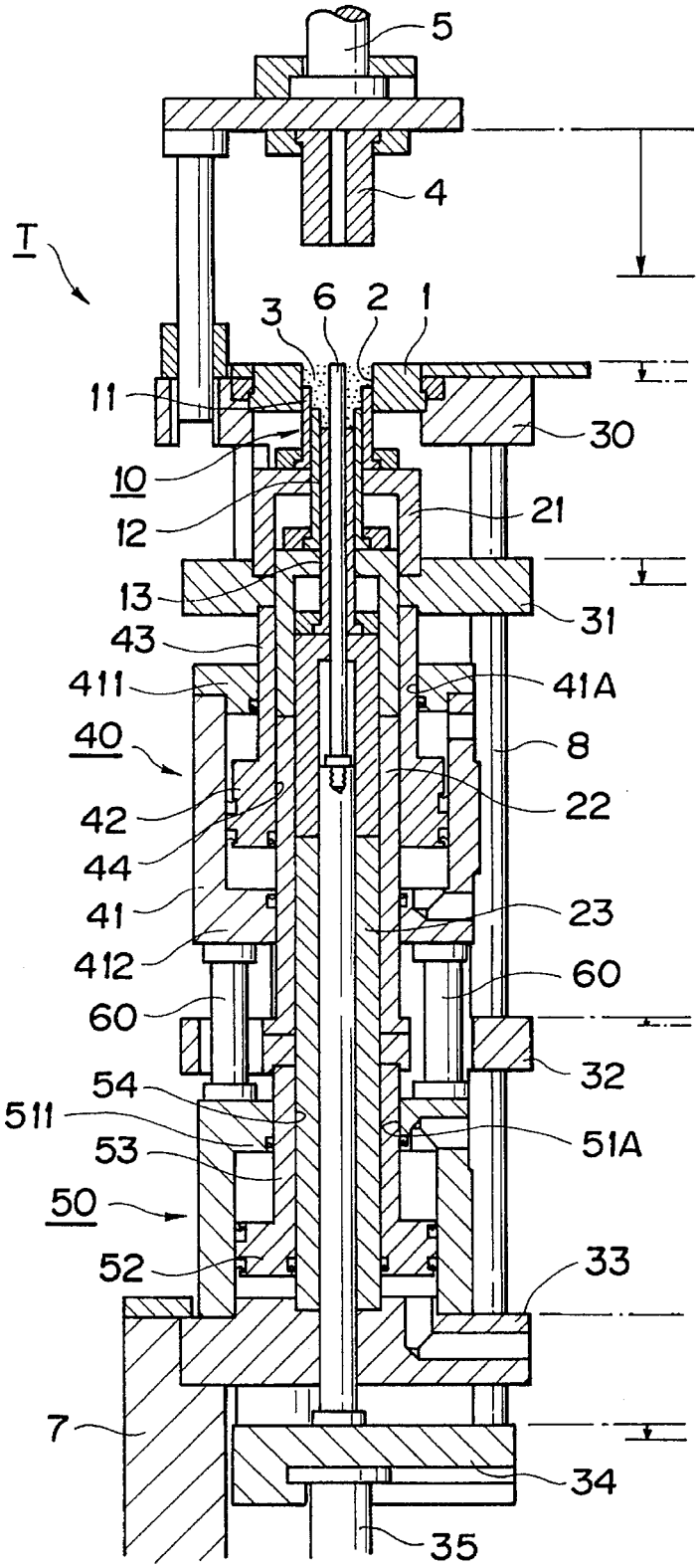
FIGS. 8 to 10 are elevational sections of the powder molding press of FIG. 1 showing, a powder filling step, a powder pressing step and a molded product take-out step, respectively.
Figure 9:
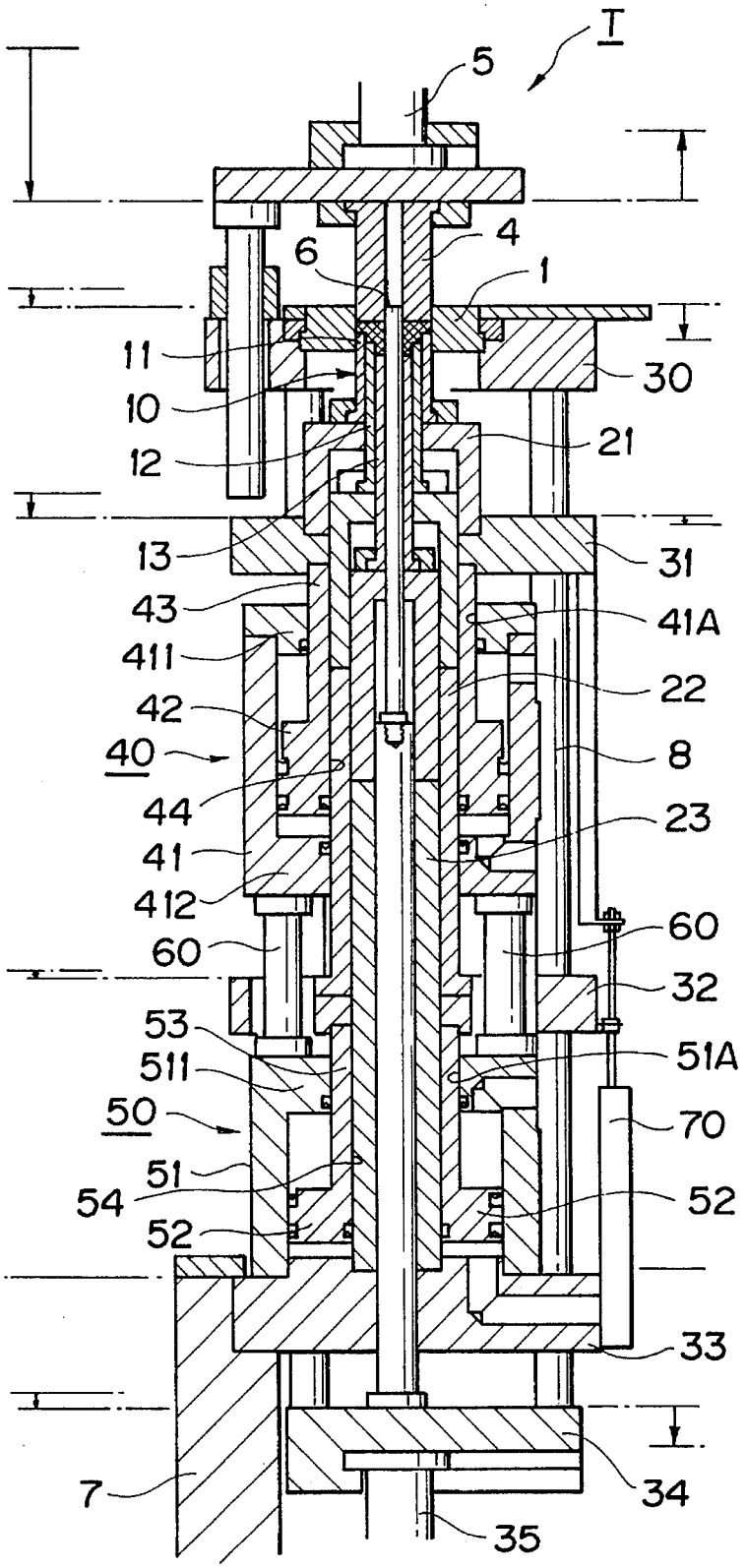
Figure 10:
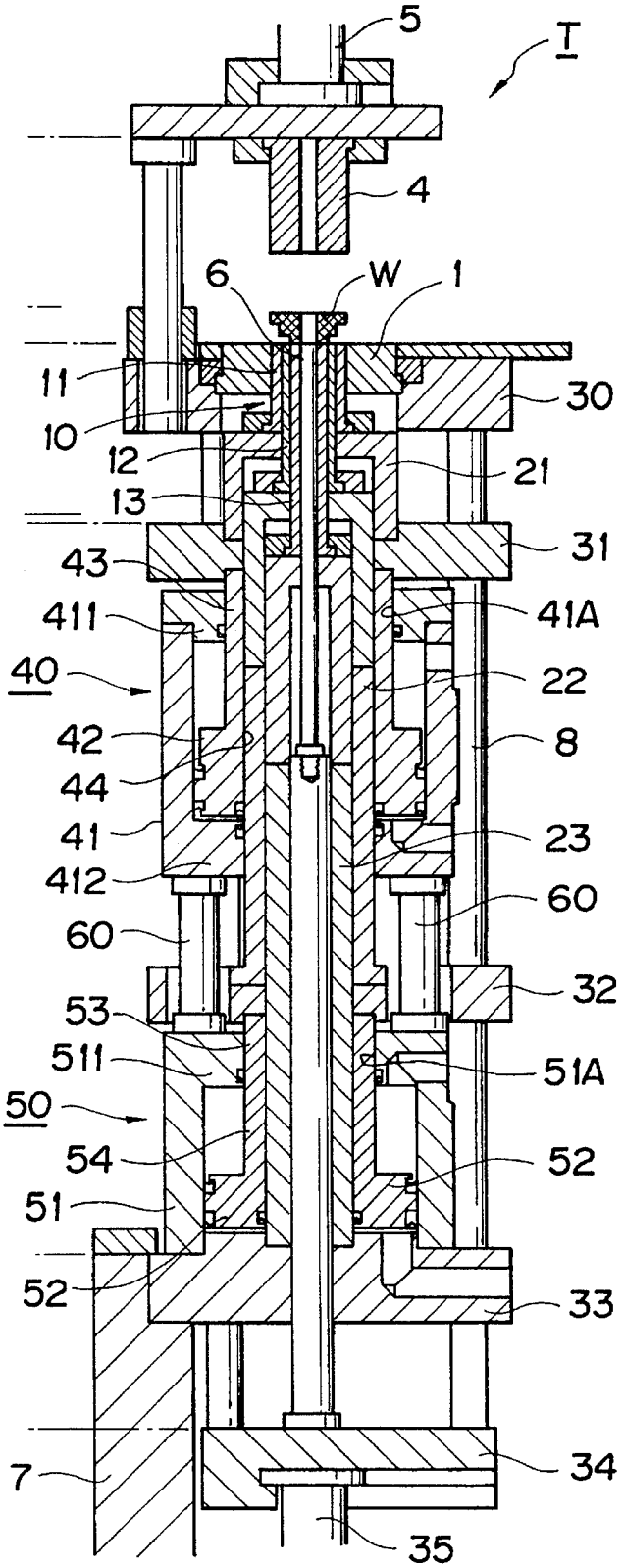

FIGS. 8 to 10 are elevational sections of the molding press in the states showing the respective molding steps. FIG. 8 represents the powder filling stage, in which the upper ram 5 is lifted upward and the upper punch device 4 is hence located above the die hole 2. The die plate 30 is positioned at the filling position by the operation of the drawing yoke 34 and the lower ram 35, and the first and second punches 11 and 12 of the lower punch device 10 are actuated and displaced by the first and second hydraulic cylinder assemblies 40 and 50 to also occupy the filling positions.

FIG. 9 represents the powder pressing stage, in which the upper punch device 4 is lowered to press the powder in the die hole 2 and the first and second punches 11 and 12 of the lower punch device 10 are also lowered to the predetermined positions to carry out the the pressing step in association with the upper punch device. During this pressing operation, the pressing forces acting on the first and second punches 11 and 12 act on the first and second punch plates 31 and 32 through the first and second punch adapters 21 and 22. Since these first and second punch plates 31 and 32 are operatively coupled, coaxially with the first and second punches 11 and 12, with the first and second hydraulic cylinder assemblies 40 and 50, the load acting points and the load supporting points of the first and second hydraulic cylinder assemblies 40 and 50 are positioned on the same axial lines, respectively, whereby the pressing forces acting on the first and second punches 11 and 12 are applied to the respective pistons 42 and 52 of the hydraulic cylinder assemblies 40 and 50 in such a manner that the pressing forces are balanced with the hydraulic pressures on substantially the same axial lines. Accordingly, the first and second punch plates 31 and 32 are not subject to a bending moment and are therefore capable of molding the product with excellent; performance.

FIG. 10 shows an arrangement of the respective members and elements in which a molded product, is taken out from the die hole.

Figure 19:
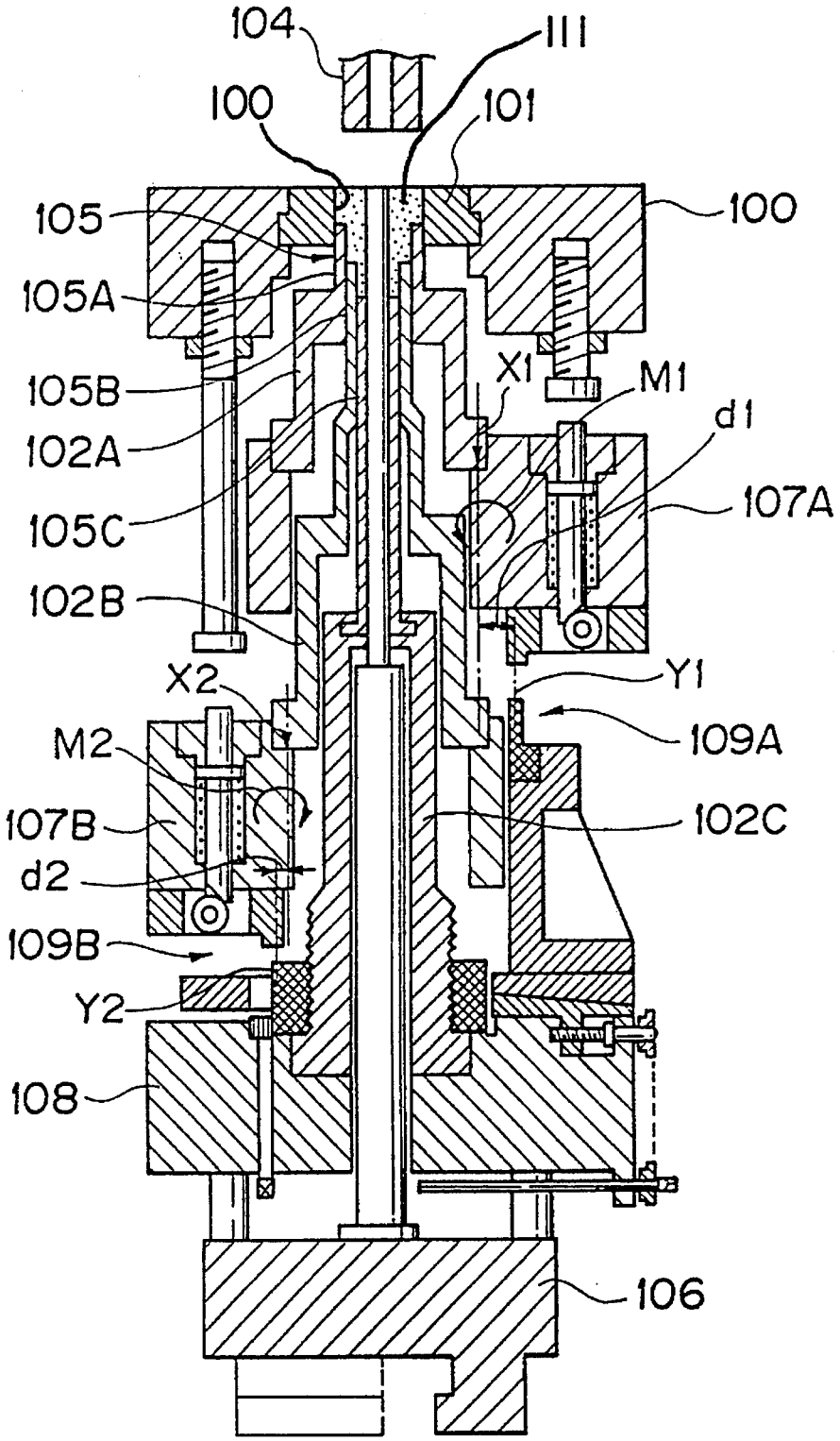
FIG. 19 PRIOR ART
FIG. 19 is an elevational section of a powder molding press of a prior art.

Furthermore, in the conventional powder molding press shown in FIG. 19, in which the mechanical stoppers are disposed, the number of punch plates is limited to two as the upper limit, whereas in the powder molding press of the present embodiment, a plurality of, more than two, punch plates can be incorporated in an axially aligning state.

Figure 13:
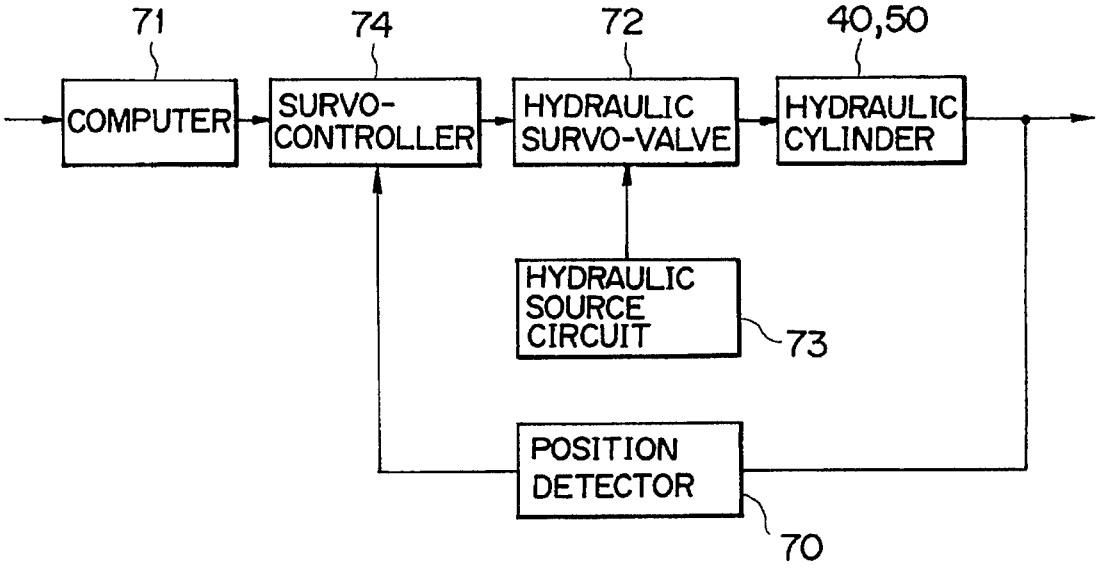
FIG. 13 is a block diagram showing one control mode of the powder molding press of FIG. 1.
Figure 14:
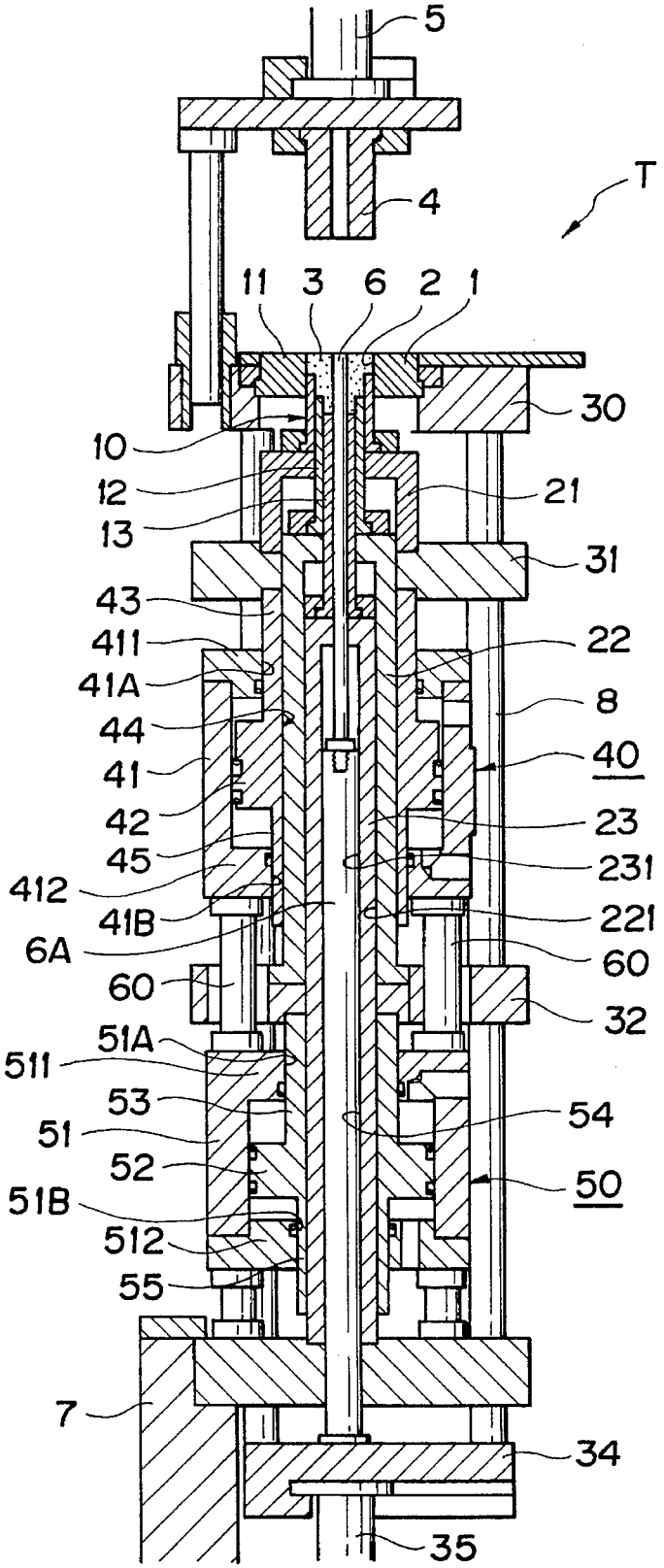
FIG. 14 is an elevational section of a powder molding press according to another embodiment of the present invention.

The described powder filling and pressing operations may be carried out by the coopeation of a position detecting means such as linear sensor 70, a computing means 71 and a hydraulic servo-valve means 72, for example, as shown in FIG. 13. The hydraulic servo-valve may be substituted with an analog-type proportional control valve or digital valve.

When the system shown in FIG. 13 is utilized, aimed positions of the first and second punch plates 31 and 32 in the respective steps are preliminarily inputted into the computing means 71, and these aimed positions are compared with the actual positions thereof detected by the position detecting means 70 and fedback to the computing means 71. In accordance with this comparison, the hydraulic servo-valve 72 is operated through a servo-controller and then the hydraulic cylinder assemblies 40 and 50 are driven under control. Hydraulic pressure is supplied to the hydraulic servo-valve 72 by a hydraulic supply source 73 of conventional type.

Although, in a case where a plurality of hydraulic cylinder assemblies are incorporated, the columns and the first and second hydraulic cylinder assemblies 40 and 50 may be deformed, influence caused by such deformation will be controlled and avoided by utilizing a closed loop system in which the positions of the punch plates 31 and 32 detected by the position detecting means 70 are fedback.

As described above, in accordance with the control of the movements of the first and second lower punches 11 and 12, no mechanical element or mechanical stoppers are required for positioning the punch plates 31 and 32 at the draw-out and powder filling positions thereof, thus making the structure of the molding press compact, reducing any mechanical trouble and reducing a manufacturing cost.

In the powder molding press of the present embodiment, the upper and lower rams 5 and 35 may be driven by a mechanical press or a hydraulic cylinder assembly.

Although in the described embodiment, the first and second punches 11 and 12 are driven by the hydraulic cylinder assemblies 40 and 50 each having an annular cross section, respectively, these punches and the upper punch device 4 may be combined concentrically to be driven by a hydraulic cylinder assembly having an annular cross section.

Figure 12A:
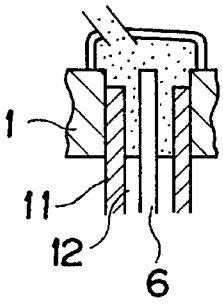
FIGS. 12A to 12E are illustrations similar to those of FIG. 11 for another molding sequence.
Figure 12B:
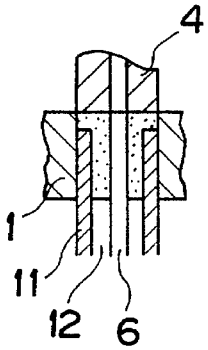
Figure 12C:
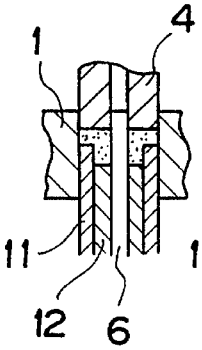
Figure 12D:
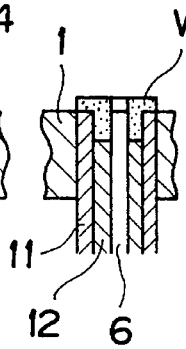
Figure 12E:
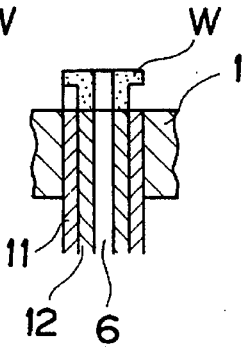

Furthermore, in the foregoing description, the punching operation is mentioned as a floating method in which the first and second punches 11 and 12 are lowered at the time of pressing and drawing operations, but other methods may be applied such as shown in FIGS. 12A to 12E. In FIGS. 12A to 12E, the die is fixed and pressed by both the upper and lower rams 5 and 35. Namely, in FIGS. 12A to 12E, the lower punch device is a splitable type of first and second punches 11 and 12, and FIG. 12A shows a powder filling step, FIG. 12B shows a powder pressing step, FIG. 12C shows a pressing end step and FIGS. 12D and 12E show a molded product take-out step.

In an alternate, form the present invention takes a structure directly combined with a press without utilizing the tool set.

Figure 15:
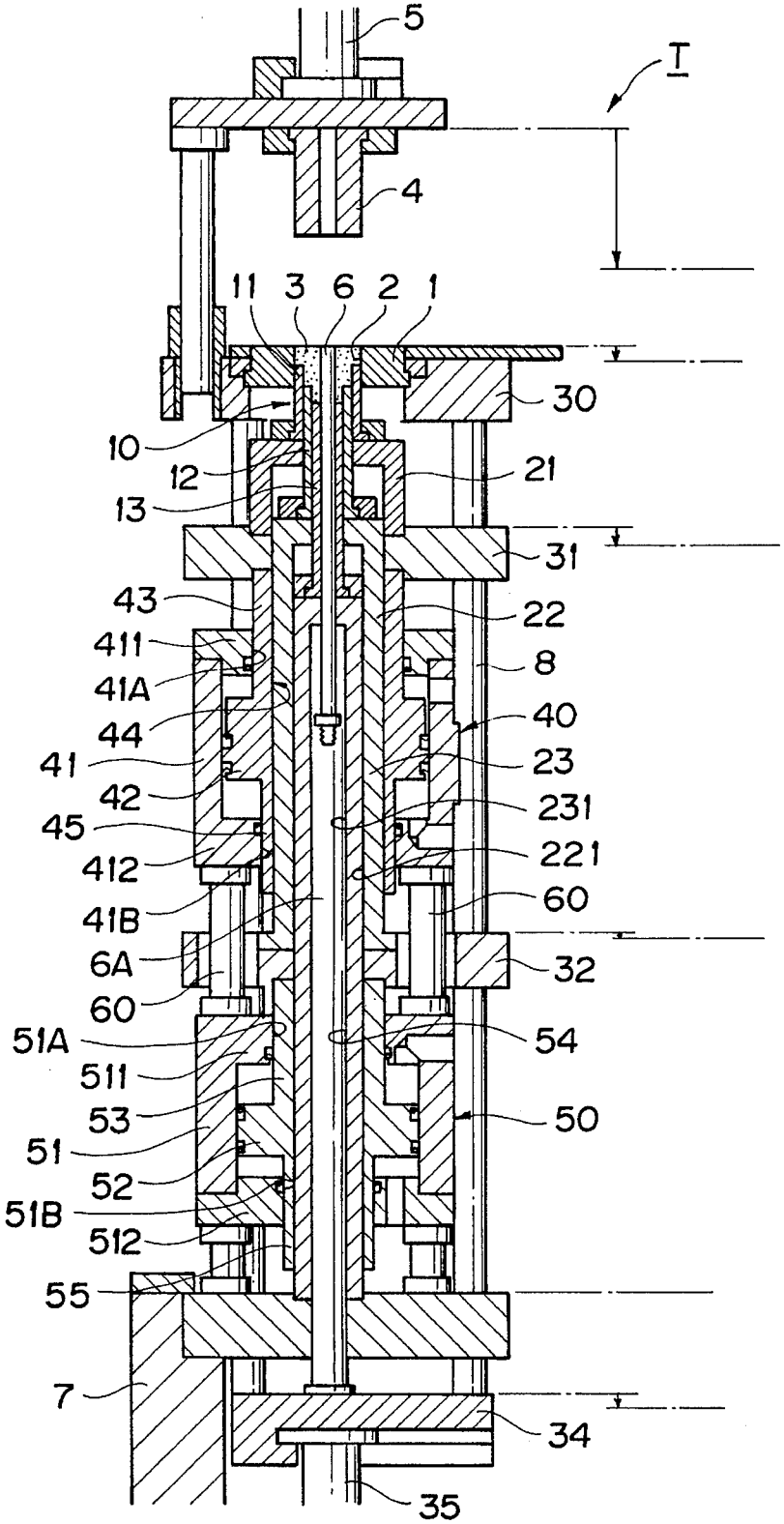
FIGS. 15 to 17 are elevational sections showing a powder filling step, a powder pressing step and a molded product take-out step, respectively, according to this another embodiment.
Figure 16:
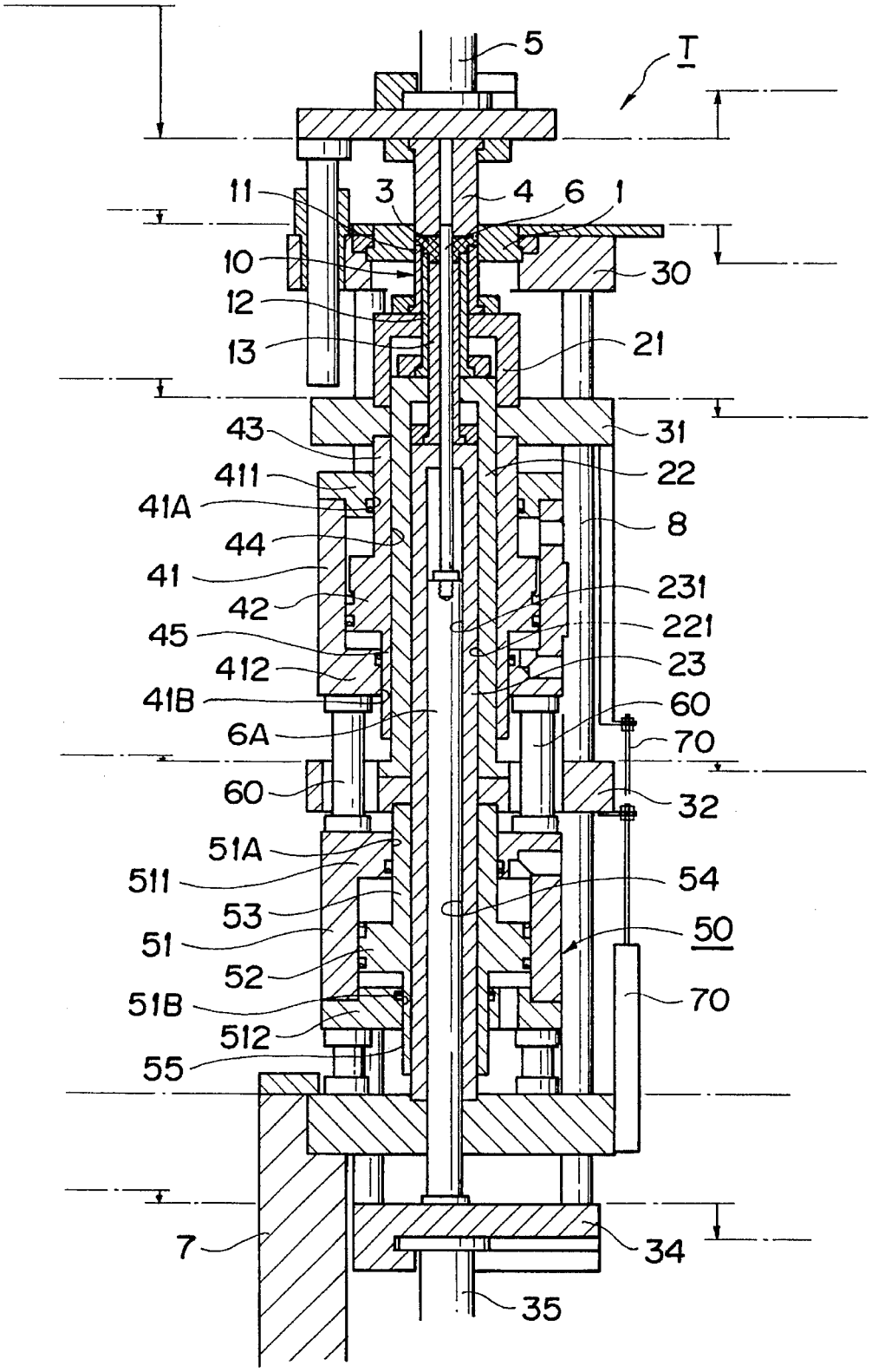
Figure 17:
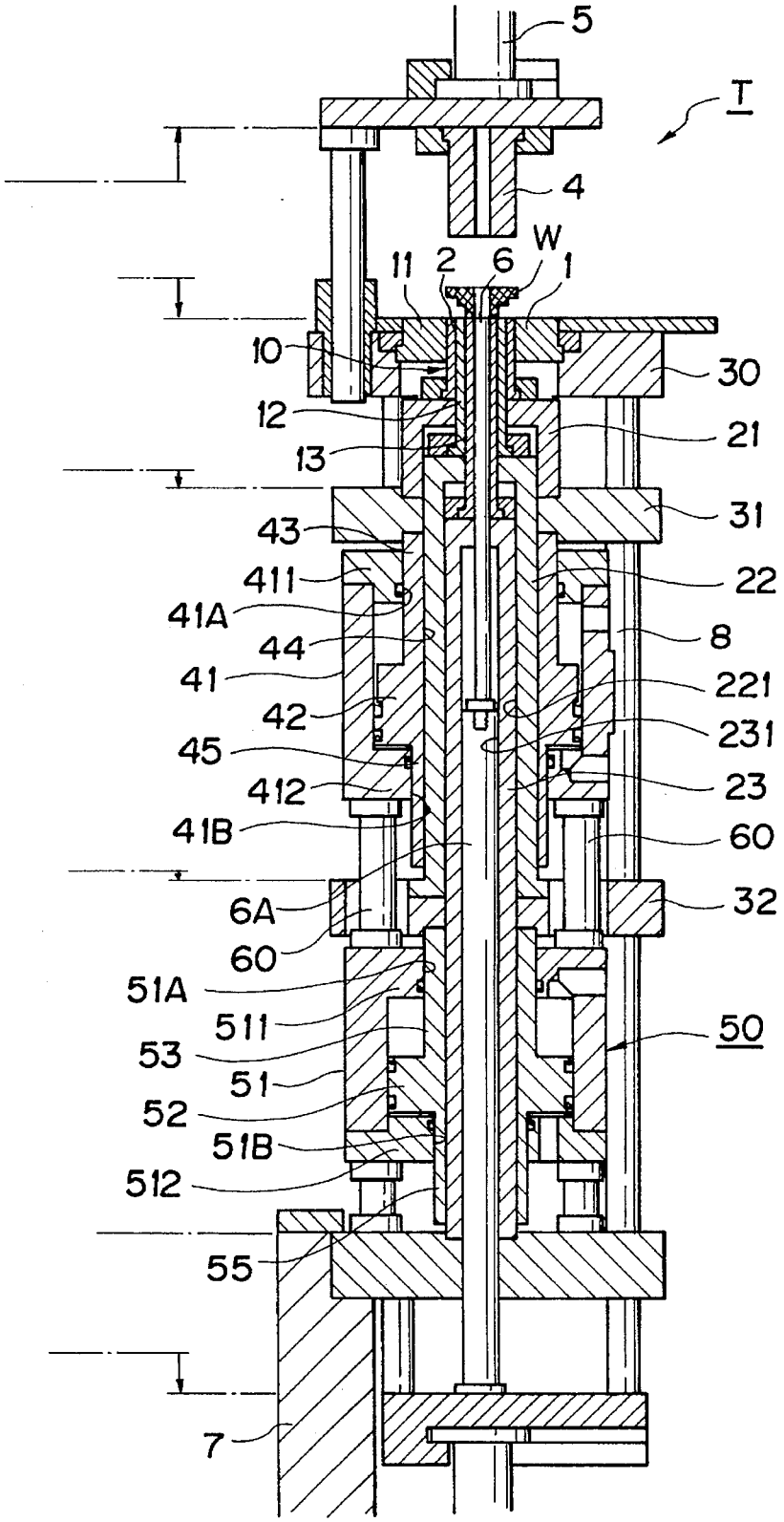

FIGS. 14 to 17 represent another embodiment according to present invention, in which FIG. 15 corresponds to FIG. 8 of the former embodiment showing the powder filling step, FIG. 16 corresponds to FIG. 9 showing the powder pressing step arid FIG. 17 corresponds to FIG. 10 showing the take-out step.

This embodiment differs from the former embodiment in a point that the first and second hydraulic cylinder assemblies 40 and 50 are double-ended pistons. Namely, hollow guide shafts 45 and 55 are provided to extend at the sides opposite to piston rods 43 and 53 o f the first and second hydraulic cylinder assemblies 40 and 50. Rod shaft holes 41A and 51A of cylinder tubes 41 and 51 of the hydraulic cylinder assemblies 40 and 50 are provided to end walls 411 and 511, and opposite end walls 412 and 512 are formed with guide shaft holes 41B and 51B into which the guide shafts 45 and 55 are inserted so that the outer periperies of the guide shafts 45 and 55 can slide along the inner peripheries of the guide shaft holes 418 and 51B.

As described above, according to this embodiment, the first and second hydraulic cylinder assemblies 40 and 50 include positions 42 and 52 which are guided at both ends by the position rods 43, 53, and the guide shafts 45, 55. The pistons 42 and 52 are inserted into the guide shaft holes 41B and 51B formed in the end walls 412 and 512 to be slidable along the inner peripheral surfaces thereof, thus improving the concentricity between the piston rods 43 and 53 and the cylinder tubes 41 and 51, respectively and also improving the performances of the first and second hydraulic cylinder assemblies 40 and 50.

In an actual operation, when powder intrudes into a gap between the first and second punches 11 and 12, there is a fear of being mixed with an operation oil in the cylinder tube 41 of the first hydraulic cylinder assembly 40 through a gap between sliding surfaces between the second punch adapter 22, the hollow piston rod 43 and the piston 42. According to the present embodiment, however, since the hollow guide shaft 45 is incorporated, the powder is dropped out of the first cylinder assembly 40 through the sliding portion between the hollow guide shaft 45 and the second punch adapter 23, thus eliminating such fear.

Furthermore, in the actual operation, when the powder intrudes into a gap between the second and third punches 12 and 13, there is a fear of being mixed with an operation oil in the cylinder tube 51 of the second hydraulic cylinder assembly 50 through a gap between the third punch adapter 23, the hollow piston rod 53 and the piston 52. According to this embodiment, however, since the hollow guide shaft 53 is incorporated, the powder is dropped out of the second hydraulic cylinder assembly 50 through the sliding portion between the hollow guide shaft 55 and the third punch adapter 23. Accordingly, since there is no fear of mixing the powder with the operation oil, the sliding resistance can be made significantly small by providing gaps between the sliding portion of the first punch adapter 21 and the through hole 44 of the first hydraulic cylinder assembly 40 and between the second punch adapter 22 and the through hole 54 of the second hydraulic cylinder assembly 50.

Other structures and operations of this embodiment are substantially identical to those of the first mentioned embodiment, so that the detailed description thereof is omitted herein by applying the same referrence numerals to members or elements corresponding to those of the first mentioned embodiment.

In the foregoing embodiments, the upper punch device may be comprised of a plurality of punches instead of punches of the lower punch device.

The respective punches may be formed integrally with corresponding punch adapters such as shown in the drawings with the same hatching lines.

In the aforementioned embodiments, the first and second punch plates 31 and 32 are secured to the first and second punch adapters 21 and 22 and the rods 43 and 53 of the first and second hydraulic cylinder assemblies 40 and 50, but the loads of the first and second punches 11 and 12 of the lower punch device are directly supported by the rods 43 and 53 of the first and second hydraulic cylinder assemblies 40 and 50. Accordingly, it may be said that the punch plates 31 and 32 have no function for supporting the loads at the powder pressing process and merely have function for preventing rotation of the first and second punches 11 and 12 and the first and second punch adapters 21 and 22.

Figure 18:
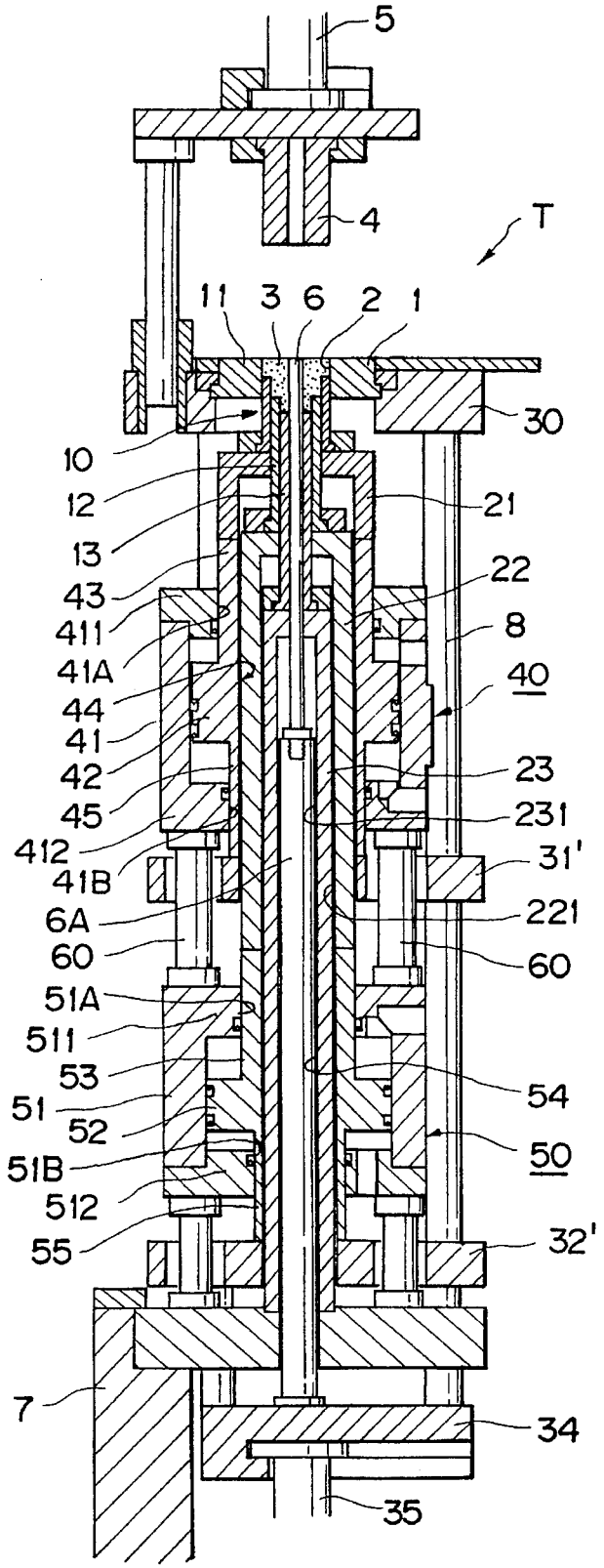
FIG. 18 is an elevational section of a further embodiment according to the present invention.

In view of this point, the object of the present invention will be also attained by the following embodiment represented by FIG. 18, in which like reference numerals are added to elements and members corresponding to those shown in figures of the aformentioned embodiments. Referring to FIG. 18, the first second and succeeding punch plates are eliminated and the first and second punch adapters 21 and 22 are directly connected to the rods 43 and 53 of the first and second hydraulic cylinder assemblies 40 and 50. The punch adpters may be eliminated by providing the function of the punch adapters to the punches and by directly connecting the punches to the hydraulic cylinder assemblies. In this embodiment, first and second rotation preventing plates 31' and 32' are secured to the hollow guide shafts 45 and 55 of the first and second hydraulic cylinder assemblies 40 and 50, respectively, for preventing the first and second punches and punch adapters from being rotated. These rotation preventing members 31' and 32' may be eliminated by providing rod rotation preventing mechanisms to the first and second hydraulic cylinder assemblies 40 and 50.

It is to be understood that the present invention is not limited to the described preferred embodiments and many other changes and modifications may be made without departing from the scope of the appended claims.

What is claimed is:

1. A powder molding press comprising:

a die plate provided with a die having a die hole;

a punch means including a pair of cooperating punch devices to be inserted into the die hole, at least one of said punch devices comprising a plurality of cylindrical punches arranged coaxially in series;

a plurality of hydraulic cylinder assemblies including one hydraulic cylinder assembly for driving each of said cylindrical punches, each of said hydraulic cylinder assemblies including an outer cylinder tube having opposed end walls, a rod shaft hole formed through one said end wall, a guide shaft hole formed through the other said end wall, a movable member axially slidable and hydraulically operated in a reciprocal motion internally of said cylinder tube, a rod secured at one end to the movable member and operatively connected at its other end for driving one of said punches, said rod slidably extending through said rod shaft hole, a guide shaft integrally formed with said movable member and extending through said guide shaft hole, a through hole formed to extend through said movable member, said guide shaft and said rod, each hydraulic cylinder assembly being axially and vertically aligned relative to the other said hydraulic cylinder assemblies with at least one element of each succeeding hydraulic cylinder assembly extending through and axially movable along an inner peripheral surface of the through hole of a directly preceding hydraulic cylinder assembly, each of said hydraulic cylinder assemblies being connected to a succeeding hydraulic assembly by a plurality of columnar members, and a plate secured to said guide shaft of each preceding hydraulic cylinder assembly and having a plurality of apertures permitting sliding movement along said plurality of columnar members and limiting rotation of said movable member and said rod of said preceding hydraulic cylinder assembly.

2. A powder molding press comprising:

a die plate provided with a die having a die hole;

a punch means including a pair of cooperating punch devices to be inserted into the die hole, at least one of said punch devices comprising a plurality of cylindrical punches arranged coaxially in series;

a plurality of hydraulic cylinder assemblies including one hydraulic cylinder assembly for driving each of said cylindrical punches, at least two of said hydraulic cylinder assemblies including an outer cylinder tube having opposed end walls, a rod shaft hole formed through one said end wall, a guide shaft hole formed through the other said end wall, a movable member axially slidable and hydraulically operated in a reciprocal motion internally of said cylinder tube, a rod secured at one end to the movable member and slidably extending through said rod shaft hole, a guide shaft secured to said movable member and extending through said guide shaft hole, a through hole formed to extend through said movable member, said guide shaft and said rod, an elongate element secured at a first end for movement by said rod and operatively connected at a second end for driving one of said punches, each of said at least two hydraulic cylinder assemblies being axially and vertically aligned relative to the other said hydraulic cylinder assemblies with said element of each succeeding hydraulic cylinder assembly extending through and axially movable along an inner peripheral surface of the through hole of a directly preceding hydraulic cylinder assembly, each of said at least two hydraulic cylinder assemblies being connected to a succeeding hydraulic assembly by a plurality of columnar members, and a plate secured to said guide shaft of each preceding hydraulic cylinder assembly and having a plurality of apertures permitting sliding movement along said plurality of columnar members and limiting rotation of said movable member and said rod of said preceding hydraulic cylinder assembly.

3. The power molding press defined by claim 2 wherein said rod and said hollow guide shaft are formed integral with said movable member.

* * * * *